United States Patent [19]

Freymond

[11] 4,437,409

[45] Mar. 20, 1984

[54] SPIN-STABILIZED SABOT PROJECTILE FOR OVERCOMING A HETEROGENEOUS RESISTANCE

[75] Inventor: Pierre Freymond, Wallisellen, Switzerland

[73] Assignee: Werkzeugmaschinenfabrik Oerlikon-Bührle Ag, Zurich, Switzerland

[21] Appl. No.: 239,664

[22] Filed: Mar. 2, 1981

Related U.S. Application Data

[63] Continuation of Ser. No. 36,768, May 7, 1979, abandoned.

[30] Foreign Application Priority Data

May 30, 1978 [CH] Switzerland ..... 5870/78

[51] Int. Cl.[3] ..... F42B 11/24; F42B 13/16

[52] U.S. Cl. ..... 102/364; 102/518; 102/523

[58] Field of Search ..... 102/364, 365, 501, 503, 102/517–523

[56] References Cited

U.S. PATENT DOCUMENTS

| | | | |
|---|---|---|---|
| 2,446,082 | 7/1948 | Dixon | 102/66 |
| 2,669,182 | 2/1954 | Weiss | 102/364 |
| 3,302,570 | 2/1967 | Marquardt . | |
| 3,561,363 | 2/1971 | Birkigt | 102/52 |
| 3,633,512 | 1/1972 | Schlack . | |
| 3,677,181 | 7/1972 | Giljarhus et al. | 102/364 |
| 3,927,618 | 12/1975 | Engel | 102/93 |

FOREIGN PATENT DOCUMENTS

| | | |
|---|---|---|
| 1952494 | 4/1971 | Fed. Rep. of Germany . |
| 2111736 | 9/1971 | Fed. Rep. of Germany . |
| 1703747 | 3/1972 | Fed. Rep. of Germany . |
| 1192170 | 10/1959 | France . |
| 1212390 | 3/1960 | France . |
| 2033907 | 11/1970 | France . |
| 2356906 | 6/1977 | France . |
| 134435 | 8/1973 | Norway . |
| 422584 | 4/1967 | Switzerland . |
| 470648 | 6/1968 | Switzerland . |
| 536481 | 6/1973 | Switzerland . |
| 128961 | 6/1919 | United Kingdom . |
| 518545 | 3/1940 | United Kingdom . |
| 578991 | 7/1946 | United Kingdom . |
| 690616 | 4/1953 | United Kingdom . |
| 1205167 | 9/1970 | United Kingdom . |
| 1228204 | 4/1971 | United Kingdom . |
| 1278021 | 6/1972 | United Kingdom . |
| 1405329 | 9/1973 | United Kingdom . |
| 1335076 | 10/1973 | United Kingdom . |
| 1426813 | 3/1976 | United Kingdom . |

*Primary Examiner*—Harold J. Tudor

*Attorney, Agent, or Firm*—Werner W. Kleeman

[57] ABSTRACT

A sabot projectile is disclosed which does not require any complicated fuze and which, during combating targets, especially targets having overlying or tandemly arranged armored plating or other reinforcements, neither explodes upon hitting the first plate nor penetrates all of the plates, without fragmenting. For this purpose, the sabot projectile has a projectile body possessing an axial channel which is closed by a ballistic hood and which is filled with an incendiary charge.

5 Claims, 5 Drawing Figures

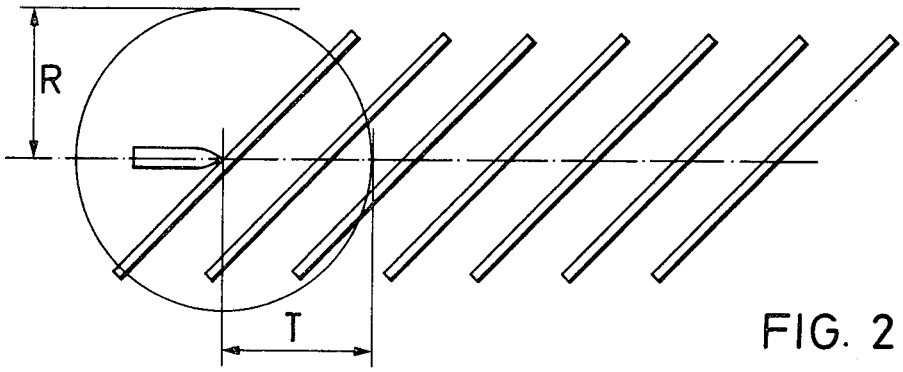
FIG. 2
FIG. 3
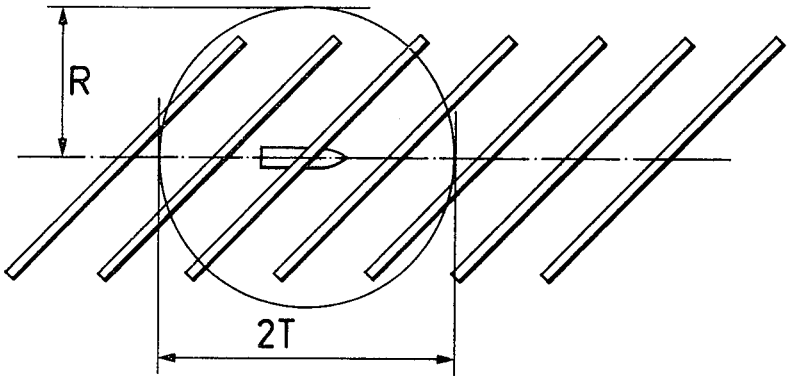
FIG. 4
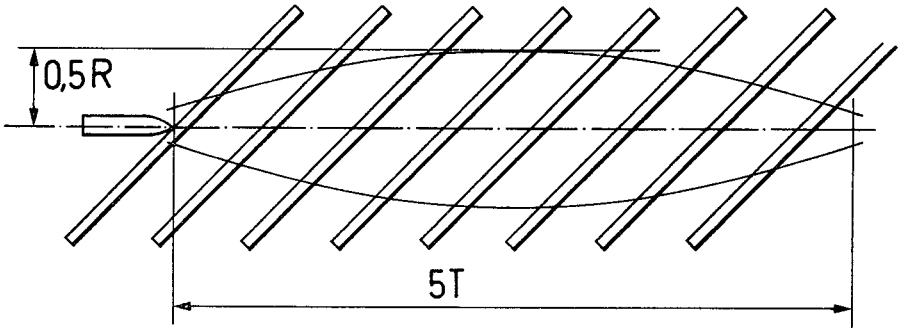

SPIN-STABILIZED SABOT PROJECTILE FOR OVERCOMING A HETEROGENEOUS RESISTANCE

CROSS REFERENCE TO RELATED APPLICATION

This application is a continuation application of my commonly assigned copending U.S. application Ser. No. 36,768, filed May 7, 1979, now abandoned.

BACKGROUND OF THE INVENTION

The present invention relates to a new and improved construction of a spin-stabilized sabot projectile for overcoming a heterogeneous resistance, such sabot projectile containing a projectile body formed of heavy metal.

According to a state-of-the-art sabot projectile of this type, as disclosed in Swiss Patent No. 536,481, there is provided a solid projectile body or projectile having a large penetration capability for thick armored plates, which, however, at the target, simply passes through a large number of thin plates without fragmenting and without causing any extensive damage.

SUMMARY OF THE INVENTION

Therefore, with the foregoing in mind it is a primary object of the present invention to provide an improved construction of sabot projectile which is not afflicted with the aforementioned drawbacks and limitations of the prior art proposals.

Another and more specific object of the present invention aims at providing a new and improved construction of sabot projectile which, upon hitting a target having tandem reinforcement or armoring, such as armor plating, does not explode upon striking the first plate, and further, does not penetrate through all of the plates without fragmenting.

Yet a further significant object of the present invention resides in an improved construction of sabot projectile which is suitable for combating both manned and unmanned flying bodies or missiles, ground-fighting aircraft, combat helicopters, rockets as well as tanks and armored personnel carriers or lightly armored vehicles and the like, such sabot projectile having a projectile body which also fragments upon penetrating relatively thin plates, and therefore causes more extensive damage, i.e., delivers a greater amount of energy at the aforementioned targets, than if it were to penetrate such target without fragmentation.

Now in order to implement these and still further objects of the invention, which will become more readily apparent as the description proceeds, the spin-stabilized sabot projectile of the invention, which is capable of overcoming a heterogeneous resistance, comprises a projectile body formed of heavy metal. This projectile body possesses an axial channel, in order to obtain a large radial effect, and the front of such projectile body is closed by a ballistic hood.

Now there is already known to the art from Swiss Patent No. 470,648 a projectile whose projectile body is provided with an axial channel. Here, however, the projectile is not a sabot projectile. Hence, this prior art projectile does not attain the requisite initial velocity of about 1500 m/sec, which is needed for the positive hitting of targets which are at a relatively great distance.

Furthermore, there is known a different type of projectile having a projectile body provided with an axial channel, as the same as has been disclosed for instance in the German Patent Publication No. 1,952,494. Also this state-of-the-art projectile is not a sabot projectile, and thus, in order to improve the initial velocity there is not used any heavy metal, so that the penetration effect at the target is relatively modest.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 illustrates the penetration depth of a prior art projectile, for instance a shell, having a head fuze and shown striking a target having overlying or tandemly arranged armored plating or the like;

FIG. 3 illustrates the penetration depth of a prior art projectile, for instance a shell, having a tail fuze, at a target provided with overlying or tandemly arranged armored plating or the like;

FIG. 4 illustrates the penetration depth of the sabot projectile of the invention shown in FIG. 1 upon striking a target having overlying or tandemly arranged armor plating;

and

Figure 5:
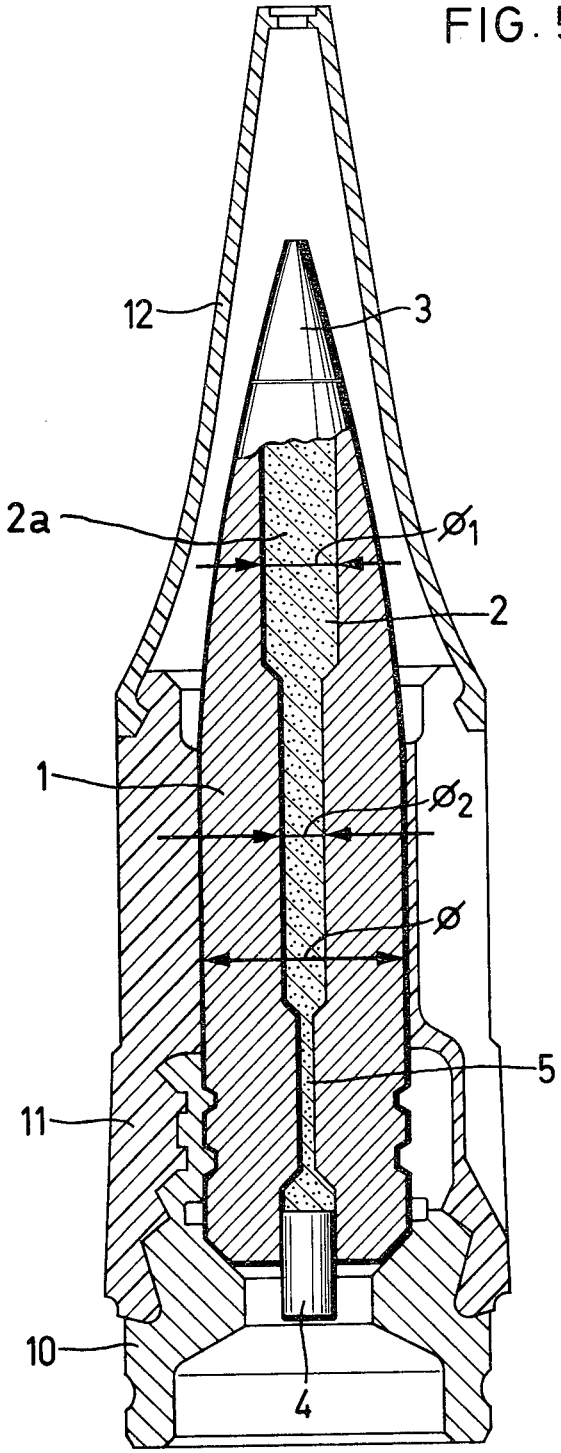

FIG. 5 is an axial sectional view of a second exemplary embodiment of sabot projectile according to the invention.

DETAILED DESCRIPTION OF THE PREFERRED EMBODIMENTS

Figure 1:
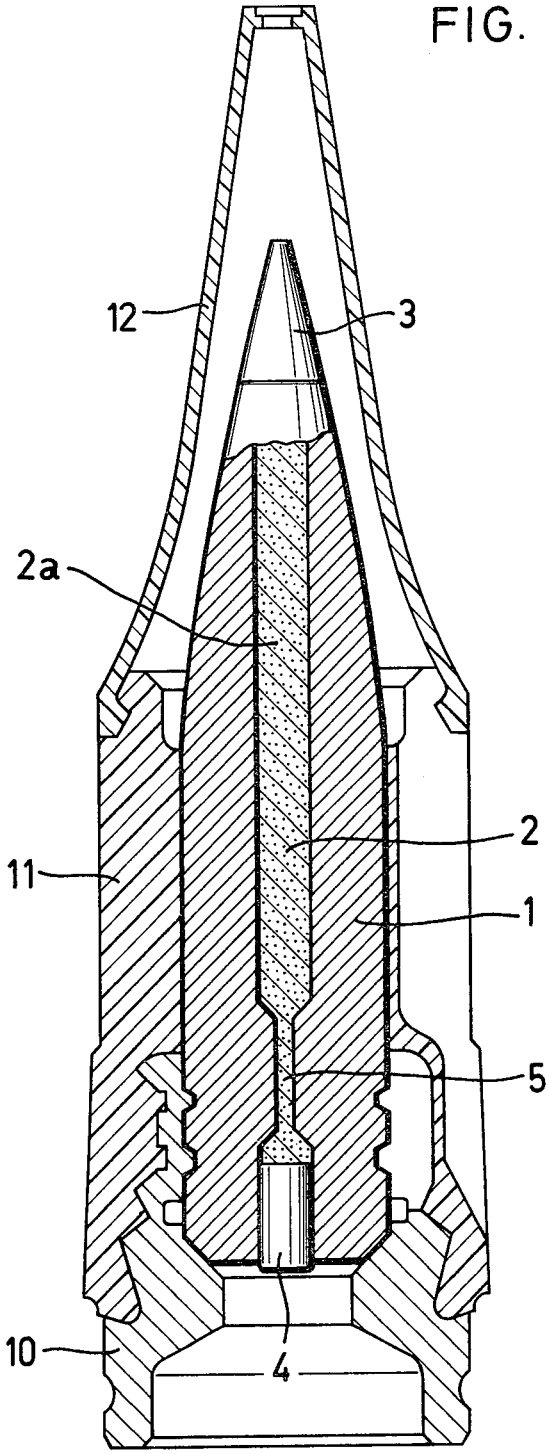
FIG. 1 is an axial sectional view through a sabot projectile according to the invention.

Describing now the drawings, the exemplary embodiment of spin-stabilized sabot projectile shown in FIG. 1 will be seen to constitute a three-part sabot composed of a tail portion 10, a jacket or shell 11 and a substantially cylindrical hood 12. This sabot 10, 11 and 12 contains a projectile body or projectile 1 which is provided with an axial channel 2. At the front end or forward end region of the projectile body 1 this axial channel 2 is provided with a projectile tip or ballistic hood 3 constituting closure means for such channel. At the rear or tail end of the projectile body 1 there is provided a flare or tracer charge 4 which is connected by means of a delay charge 5 with a generally indicated incendiary charge **2*a* arranged within the channel 2**.

Details of the sabot are unimportant as concerns understanding the underlying concepts of the invention, and therefore, beyond what has been stated herein will not be further described. Yet, a detailed description of the sabot, which may be used in the sabot projectile of the invention, has been given in Swiss Patent No. 536,481, the disclosure of which is incorporated herein by reference.

The described projectile serves, for instance, for combating low-flying aircraft, manned and unmanned flying bodies, ground-fighting aircraft, combat helicopters, rockets, tanks, armored-personnel carriers or lightly armored vehicles, and the fighting of these targets is rendered more difficult for the following reasons. Taking aircraft as an example of a target, such increasingly become faster and more maneuverable and, furthermore, contain improved armoring composed of an increasing number of armor plates or the like. Defensive ammunition employing proximity fuzes are only effective against such type aircraft if there is used a weapon bore caliber of 70 mm or more. However, such ammunition cannot be effectively employed due to the long reaction time of such weapons. An effective defense against low-flying aircraft thus requires a direct hit of the target. Since, as stated, the target is increasingly more effectively protected with light metal, ceramic and plastic plates, the projectile must be structured such that only after penetrating a number of layers of such armoring or reinforcement, will it disintegrate, i.e., it must possess a good penetration depth.

The described projectile is suitable for bore calibers between 20 to 50 mm. The projectile body 1 is formed of a material having a specific weight of at least 17 gr/cm$^3$. By means of the sabot 10, 11, 12 the projectile body 1 has imparted thereto an initial velocity $V_o$ of about 1500 mm/sec. By virtue of the high specific weight and the large initial velocity there is beneficially realized a shorter flight time in relation to conventional ammunition, thereby increasing the hit probability.

The disintegration or fragmentation of the projectile body 1 is governed by the resistance encountered at the target, i.e., by the plates penetrated by the projectile. The greater the resistance of the individual plates, that much greater the fragmentation, i.e., there are produced a larger number of splinters, part of which originate from the projectile body 1 and part of which originate from the target. These splinters or the like likewise penetrate into the target and are extremely effective owing to their large specific weight.

The projectile body 1 is preferably fabricated from a uranium alloy or another suitable heavy metal. The uranium alloy contains at least approximately 92% by weight U-238. The employed material should possess a large elasticity of at least 12% and a large notch impact strength. The large elasticity prevents premature fragmentation.

During penetration of armored plating the projectile body 1 is continuously crumbled away at the region of the channel 2, and thus, there is a loss in mass. The remaining part of the projectile body 1 becomes increasingly more stable, since the ratio between the diameter of the projectile body and the length of the projectile body changes in a favorable sense. Hence, the projectile penetrates, as required, more deeply into the target. This desired projectile penetration is required in order to obtain a large radial effect of the splinters or the like.

The incendiary charge **2*a* in the channel 2 of the projectile body 1, upon penetration of the projectile at the target, together with the projectile body 1** continuously loses in mass.

The self-destruction of the projectile is insured by the flare charge 4, the delay charge 5 and the incendiary charge **2*a* in the channel 2, this incendiary charge possessing a certain explosive or shattering power. Upon burning-out of the flare charge 4 there is ignited the pyrotechnic delay charge 5 which, after a certain time, ignites the incendiary charge in the channel 2**.

Now in FIG. 2 there is illustrated a conventional shell having a head fuze which is already ignited at the first plate after striking the target. The effective radius R and the penetration depth T, in this case, are of approximately the same magnitude, i.e., R=T.

According to the showing of FIG. 3, a further conventional shell having a tail fuze, upon hitting the target, penetrates about one to two plates, in accordance with the delay time of the tail fuze, before it is ignited. The penetration depth T is approximately twice as large, but the effective radius remains about the same.

Now in FIG. 4 the inventive projectile will be seen to penetrate at least five times as deeply into the target before it completely fragments, since a fuze is not contemplated. On the other hand, the effective radius is somewhat smaller, for instance amounts to about 0.5 R. The elasticity of the employed material and the relationship or ratio between the channel diameter and the projectile diameter can be chosen such that the penetration depth and effective radius are optimumly accommodated or conformed to one another. Preferably, the channel 2 can have a larger diameter at the front end of the projectile than at the intermediate region or portion thereof.

With the modified embodiment of sabot projectile as shown in FIG. 5, the channel 2, at the front end or forward end region of the projectile 1, has a diameter $\phi_1$, which amounts to about 40% of the projectile diameter $\phi$. At the intermediate region of the projectile 1 the channel 2 has a diameter $\phi_2$ which only amounts to about 20% of the projectile diameter $\phi$.

While there are shown and described present preferred embodiments of the invention, it is to be distinctly understood that the invention is not limited thereto, but may be otherwise variously embodied and practiced within the scope of the following claims. Accordingly,

I claim:

1. A spin-stabilized sabot projectile for overcoming a heterogeneous resistance, comprising:

sabot means;

a projectile body carried by said sabot means;

said projectile body having an axial channel means for obtaining an increased radial effect of splinters or the like from the projectile body upon fragmentation thereof after penetration of said heterogeneous resistance;

said axial channel means containing an incendiary charge;

said projectile body having a specific weight of at least 17 gr/cm$^3$;

said axial channel means having a forward end region and an intermediate region;

said forward end region of said axial channel means having a larger diameter than said intermediate region;

said projectile body having a front region;

a ballistic hood means for closing said front region of said projectile body;

said axial channel means possesses at said forward end region a diameter amounting to approximately 40% of the diameter of the projectile body, such that the projectile body continuously crumbles away at the region of said axial channel means upon penetration of the projectile body at the heterogeneous resistance;

said axial channel means possessing at said intermediate region a diameter amounting to approximately 20% of the diameter of said projectile body; and said axial channel means being filled with said incendiary charge such that the penetration depth of the projectile is conformed to the radial effect of said projectile.

2. The sabot projectile as defined in claim 1, wherein:

said spin-stabilized sabot projectile is used in weapons having a bore caliber in the order of between 20 to 50 mm.

3. The sabot projectile as defined in claim 1, wherein:

said specific weight of said projectile body imparts a large initial velocity to the projectile body amounting to at least about 1500 mm/sec.

4. The sabot projectile as defined in claim 1, wherein:

said incendiary charge substantially completely fills said larger diameter forward end region of said axial channel means.

5. The sabot projectile as defined in claims 1, wherein:

said sabot projectile is devoid of any fuze, so as to thereby enhance the penetration depth of the sabot projectile prior to its fragmentation.

* * * * *